US005979553A

United States Patent [19]

Brink

[11] Patent Number: 5,979,553

[45] Date of Patent: Nov. 9, 1999

[54] METHOD AND APPARATUS FOR COMPLETING AND BACKSIDE PRESSURE TESTING OF WELLS

[75] Inventor: Donald J. Brink, 305 Oakmount, Broussard, La. 70518

[73] Assignees: Altec, Inc.; Donald J. Brink, both of Broussard, La.

[21] Appl. No.: 08/847,076

[22] Filed: May 1, 1997

[51] Int. Cl.[6] ..... E21B 47/00

[52] U.S. Cl. ..... 166/250.08; 166/321; 166/372; 137/155; 417/109

[58] Field of Search ..... 166/372, 250.08, 166/332.6, 321, 117.5, 117.6, 317, 319; 137/155; 417/109

[56] References Cited

U.S. PATENT DOCUMENTS

| | | | |
|---|---|---|---|
| 3,814,545 | 6/1974 | Waters | 417/109 X |
| 4,489,743 | 12/1984 | Canalizo et al. | 137/155 |
| 5,522,418 | 6/1996 | Johnson et al. | 137/155 |

*Primary Examiner*—Roger Schoeppel
*Attorney, Agent, or Firm*—James L. Jackson; Mayor, Day, Caldwell & Keeton L.L.P.

[57] ABSTRACT

A method and apparatus for completing and backside pressure testing petroleum product wells for production, with one or more differential pressure valves being present at spaced intervals within a tubing string and with a well fluid transfer device being located in the tubing string. Either after or preferably before well casing perforation, after setting of the tubing string, casing pressure is elevated to a backside test pressure, above differential pressure causing closure of the differential pressure responsive valves to ensure the integrity of seals and packers. Casing pressure is then increased to a transfer valve opening pressure, above backside test pressure, to open unidirectional flow communication of well fluid from the well casing to the production tubing. After the casing annulus has been unloaded of standing fluid to a desired level and with all regulating valves closed by differential pressure or has been balanced with formation pressure, the casing is perforated for immediate start up of well fluid production by formation pressure or other suitable production operations.

20 Claims, 3 Drawing Sheets

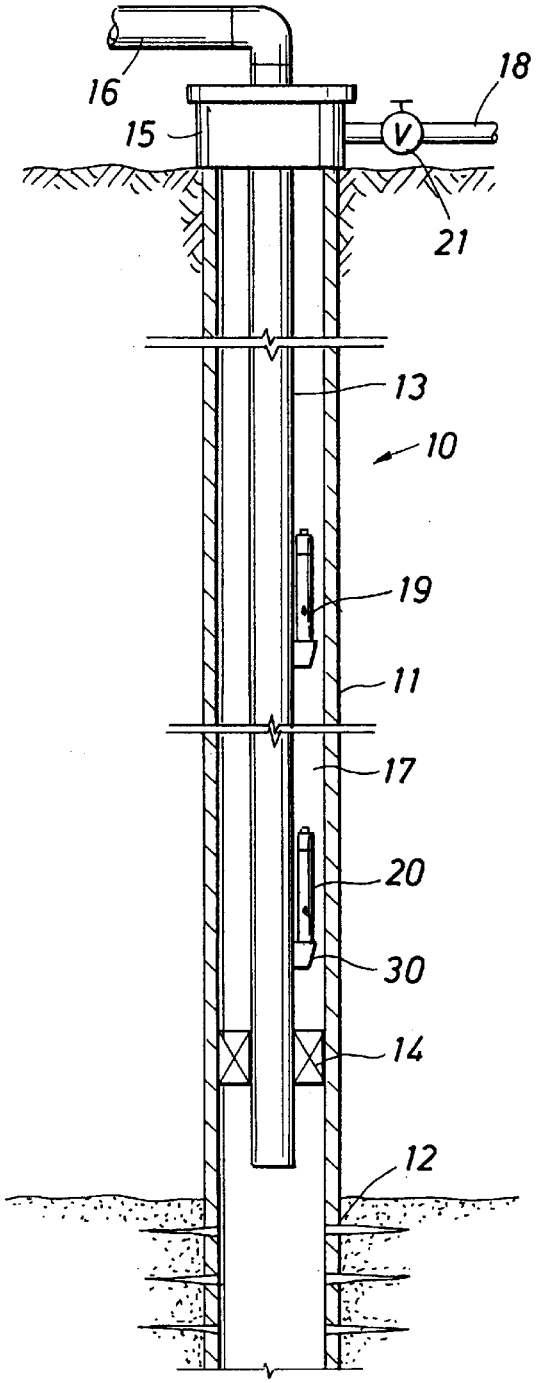
FIG. 1
FIG. 2A
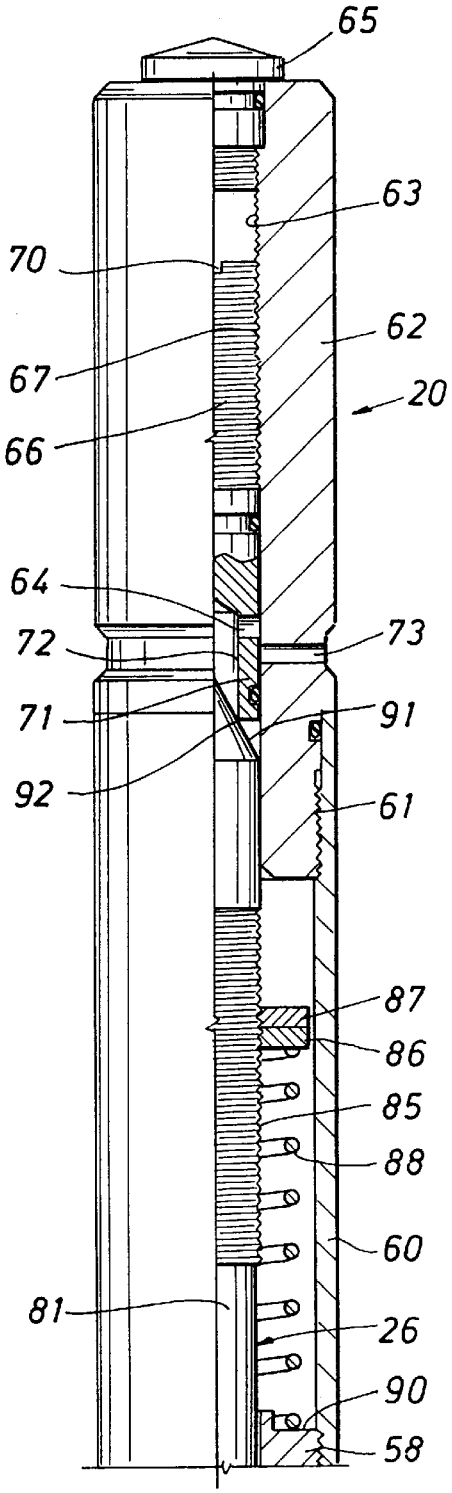

METHOD AND APPARATUS FOR COMPLETING AND BACKSIDE PRESSURE TESTING OF WELLS

BACKGROUND OF THE INVENTION

1. Field of the Invention

This invention relates generally to completion of wells for the production of fluid therefrom and more particularly concerns a method and apparatus for accomplishing pressure testing of packers seals and other pressure containing components of a well during completion activities. More particularly, the present invention concerns the method for installing a production system within a well and, prior to initiating production operations, increasing casing pressure to a level for differential pressure closure of one or more differential valves of the production tubing string, further increasing casing pressure to test the integrity of all pressure containing components such as seals, packers, etc. After the pressure testing procedure has been completed, a fluid transfer valve is opened to permit transfer of well fluid from the casing annulus into the production tubing for unloading the casing of standing well fluid in preparation for production of the well. To accommodate the problem of potential kicking of the well caused by sudden release of formation pressure into the well casing during backside pressure testing, the fluid transfer valve incorporates a unidirectional valve for blocking reverse flow of well fluid from the well bore into the production tubing.

2. Description of the Prior Art

When typical well production systems are installed within wells, after the production tubing string has been landed it is desirable to accomplish pressure testing from the casing side, or backside of the installation, so that the sealing integrity of seals, packers and other pressure containing components can be assured. Otherwise, if a condition of seal or packer leakage should exist, the abrasive condition of the well fluid can cause erosion of or other damage to well components which can require the well to be reworked to ensure efficient production of well fluid. Seal integrity is highly desirable to ensure against well blowout resulting from seal and packer leakage. Where a well is being completed for gas-lift production or is adapted for unloading by gas-lift valves, many types of gas-lift valves will prevent casing pressure testing of this nature because the valves will open and prevent desired test pressure from being reached and held so as to confirm the integrity of the seals and packers. In such case, the mandrels of the production tubing string are typically equipped with dummy valves to isolate the production tubing from casing pressure while the well casing pressure is increased to test pressure. The casing or backside pressure test is then conducted to the desired pressure and for the desired duration to ensure the sealing integrity of the sealing components of the system. After pressure testing has been completed, wireline equipment is then used to replace the dummy valves of the mandrels with pressure responsive valves or valves that are otherwise controlled. This of course is a time consuming and expensive procedure because of the significant rig time and labor requirements that are involved.

In cases where the well casing is perforated at the production zone prior to backside pressure testing, the presence of elevated fluid pressure within the casing, which is necessary for backside pressure testing, can cause casing fluid to be forced into the producing formation surrounding the well casing. When this occurs, the formation can be damaged to the point that production from the well can be severely diminished. If, as in many cases, the well fluid is drilling fluid having a liquid carrier and containing fine, dense particulate such as barite and perhaps also containing contaminant particulate such as pipe scale, drill cuttings, metal fragments from the firing of perforating charges, etc., this liquid, slurry-like material can be forced into the formation and can block its fluid flow interstices. At times a formation seal can be developed by this material which interferes with flow of formation fluid, oil, water, natural gas, into the well bore. To prevent damage to the formation by backside pressure testing procedures it is desirable to conduct pressure testing activities prior to perforation of the well casing.

One of the principal problems with this type of pressure testing procedure is the possibility that the well can begin to kick, i.e., receive pressure from the earth formation in communication with the wellbore, at a point in the procedure where a dummy valve has been removed, but has not yet been replaced with a gas-lift regulating valve. In this case it could become necessary to kill the well by injecting fluid at a pressure exceeding formation pressure. This procedure can seriously damage the well and interfere with its subsequent production. Obviously, there is a significant risk of well blowout if the well begins to kick at a time when a valve is missing from one of the mandrel valve pockets. Also, since wireline equipment is required for retrieving dummy valves from the mandrels and replacing them with gas-lift valves, the expense of the wireline equipment and the wireline specialist personnel that are needed for wireline service activities adds significantly to the cost of the well completion procedure.

Another disadvantage of well completion activities that require wire line equipment for valve replacement is the cost of rig downtime. This is especially disadvantageous in the marine environment where rig costs and well servicing costs are prohibitive. It is desirable therefore to complete wells for production in such manner that eliminates the need for dummy valve installation and replacement and ensures, after backside pressure testing has been completed, that the well is immediately ready to begin production activities.

SUMMARY OF THE INVENTION

It is a principal feature of the present invention to provide a novel method and apparatus for well completion for production, with backside casing pressure testing of a landed production tubing string with at least one differential pressure responsive valve being present within the production tubing string and with fluid transfer means being present within the production tubing for selective communication of the production tubing with the casing such as for unloading the well or circulating fluid within the well, such as for cleaning of the well in preparation for production;

It is another feature of the present invention to provide a novel method and apparatus for completion of wells, which does not require the use of dummy valves and the consequent risk of well damage or blowout in the event the well should begin to kick during well completion activities, with one or more of the mandrel pockets open;

It is an even further feature of the present invention to provide a novel method and apparatus for well completion with differential pressure responsive valves present within a production tubing string and which close responsive to elevated casing pressure to permit backside pressure testing procedures for confirmation of seal and packing integrity;

It is among the several features of the present invention to provide a novel method and apparatus for completion of wells wherein a tubing string having valves operatively situate therein can be subjected to casing pressure test after being landed within the well casing to confirm the integrity of seals, packings and other pressure containing apparatus and well fluid transfer means of the tubing string can be opened to thus open fluid transferring communication between the casing annulus and the production tubing string for unloading the well, circulating fluid between the casing and tubing or for conducting other activities;

It is yet another feature of the present invention to provide a novel method and apparatus for completion of wells to provide a novel fluid transfer valve in a tubing string which is normally closed and which remains closed during elevation of casing pressure to a predetermined backside test pressure for confirming the integrity of seals, packers and other pressure containing apparatus of a production tubing string well completion and which can be permanently or selectively opened by casing pressure significantly above backside test pressure to communicate well fluid from the casing into the tubing string for conventional well production operations;

It is an even further feature of the present invention to provide a novel method and apparatus for completion of wells having a novel well fluid transfer valve and which, when opened, permits choke controlled continuous transfer of well fluid under casing pressure from the well casing and into the production tubing string at all casing pressure ranges; and It is also a feature of the present invention to provide a novel method and apparatus for well completions having novel well fluid transfer means, such as a valve, which permits only unidirectional flow of well fluid from the casing, through the valve mechanism and into the tubing string and which prevents backflow of well fluid through the valve and toward the well casing.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the drawings:

FIG. 1 is a schematic illustration of a well having a well casing lining a well bore and showing installed or "landed" within the casing a fluid production string having at least one differential pressure responsive valve mechanism therein;

FIG. 2A is a sectional view of the upper portion of a differential pressure responsive valve mechanism which may comprise a component of a well production tubing string having one or more differential pressure responsive valves therein which permit backside pressure testing capability according to the method and with the apparatus of the present invention;

FIG. 2B is a sectional view of the lower portion of the differential pressure responsive valve mechanism of FIG. 2A;

FIG. 3 is a quarter sectional view of a differential pressure responsive fluid transfer valve mechanism which is constructed in accordance with the principles of the present invention;

FIG. 4 is a sectional view taken along line 4—4 of FIG. 2B; and

FIG. 5 is a partial sectional view of an alternative embodiment of the present invention wherein a differential pressure responsive fluid transfer valve is operative to open or close responsive to a range of casing pressure exceeding backside test pressure.

DETAILED DESCRIPTION OF PREFERRED EMBODIMENT

Figure 2B:
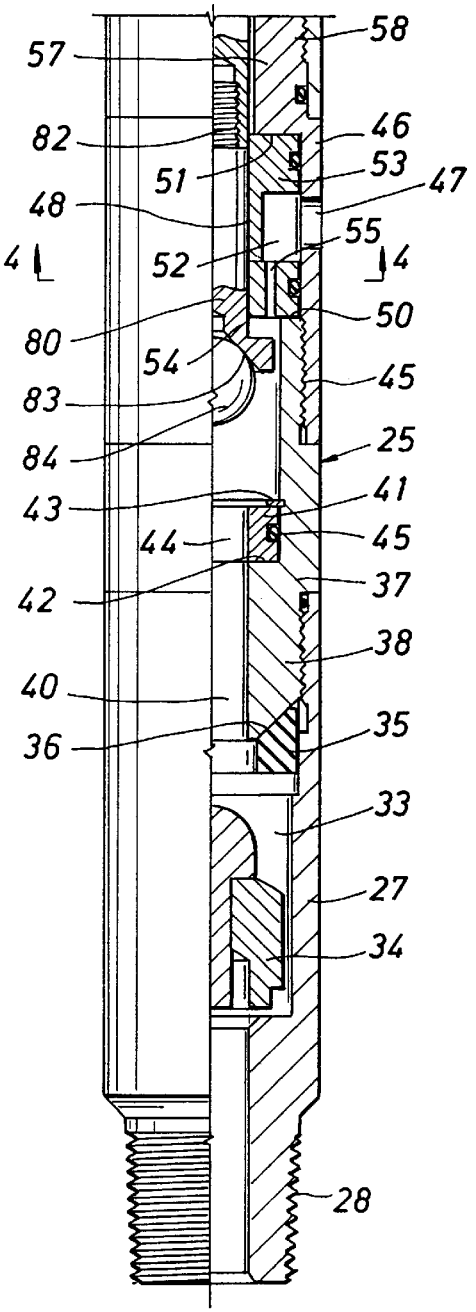

Referring now to the drawings and initially to FIG. 1, a wellbore 10 is lined with a well casing 11 that, during well completion is perforated at 12 so that oil and other well fluid from a subsurface earth production zone can enter the casing. A production tubing string 13 extends from the surface down to a packer 14 which is set above the perforations 12 so that the oil and other well fluid must flow up the tubing to the surface, through a casing head 15 and into a production line 16. A series of spaced regulating valves 19 are mounted on the tubing 13, with the lowermost regulating valve being arranged to control the injection of fluid from the annulus 17 into the tubing. Each of the valves of the production tubing string is preferably a differential pressure responsive valve of the construction and function as set forth in U.S. Pat. No. 5,522,418 of Johnson et al, though other differential pressure responsive valves may also be employed in the production tubing string without departing from the spirit and scope of the present invention. If gas-lift production of the well is intended, gas pressure for production of the well is supplied to the annulus 17 between the casing and tubing at the surface by a suitable compressor (not shown) through the line 18 via a valve 21. The upper differential pressure valves 19 typically are used only for initially "unloading" any liquids such as salt water in the annulus 17 down to the bottom differential pressure valve. During such unloading a portion of the oil in the tubing 13 may also be unloaded. In any event, for production of the well, the bottom differential pressure valve is used to aerate the oil column in the tubing 13 with gas so that the natural pressure of the oil in the production zone is sufficient to lift the reduced density oil to the surface. Once differential pressure is initiated the upper valves 19 remain closed. In fact the bottom differential pressure valve will prevent the adjacent pressure in the tubing 13 from rising to a level where the oil cannot be produced to the surface.

As shown in FIG. 2, each of the differential pressure responsive valves 19 includes a tubular valve body 25 having a valve member indicated generally at 26 movably arranged therein. In one form of the invention the body 25 includes a lower sub 27 having external threads 28 by which the valve is secured to a lug 30 (FIG. 1) located externally of the tubing string. It should be borne in mind that the present invention is preferably applicable to production tubing strings having a plurality of side pocket mandrels connected in spaced relation therein, each having internal valve pockets which communicate with the annulus between the casing and the tubing string. Each of the valve pockets each also communicate with the internal flow passage of the tubing string, with fluid flow from the annulus into the tubing being controlled by a differential pressure regulating valve that is seated with in the respective valve pocket.

For external regulating valve mounting, a mounting lug 30 typically is welded to the tubing 13 and has a passage that communicates with a radial port through the wall thereof. The sub 27 forms an internal cavity 33 that receives a check valve 34 which can shift upwardly in response to flow velocity and engage an annular seal 35 to prevent back flow of oil to the outside of the tubing 13. However the check valve 34 automatically moves down to its open position, as shown, when fluid is being injected into the tubing 13. The seal 35 engages a shoulder 36 provided by an adapter sleeve 37 whose lower end is threaded to the sub 27 at 38. The respective bores of the adapter sleeve 37 and the lower sub 27 provide a gas flow passage 40. The threads 38, as well as all other threaded connections between housing components are sealed as shown against fluid leakage.

Figure 3:
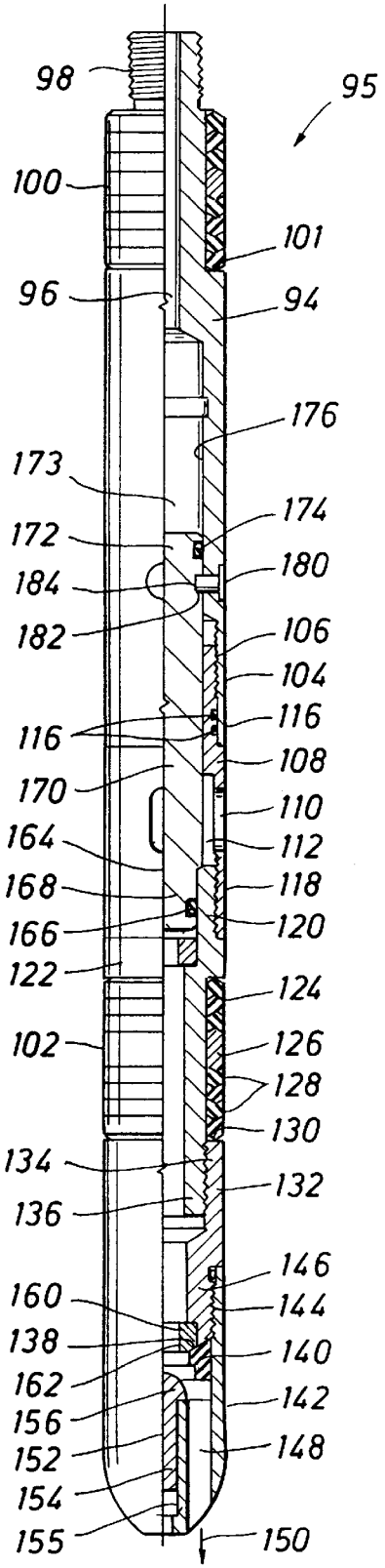
Figure 4:
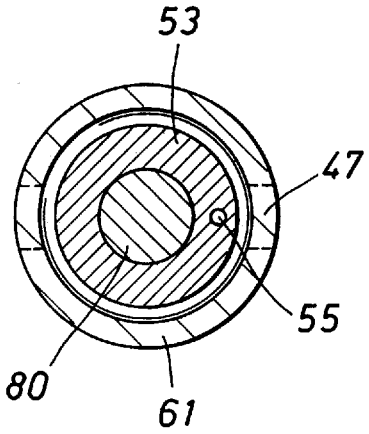

A seat ring 41 is held against a shoulder 42 in the sleeve 37 by a retainer 43. Thus the bore 44 of the seat 41 surrounds the flow passage 40. A seal ring 45 prevents leakage. The upper end of the sleeve 37 is threaded at 45 to a port sleeve 46 having one or more large fluid entry ports 47 through the wall thereof. An orifice spool 48 is mounted between the upper end surface 50 of the sleeve 37 and a downwardly facing shoulder 51 on the port sleeve 46. The spool 48 has an external annular recess 52 formed therein which provides upper and lower flanges 53, 54. The lower flange 54 has an axially extending orifice 55 so that fluid on the outside of the housing or body 25 which enters through the ports 47 can flow into the passage 40 above the seat ring 41. However the flow is considerably restricted due to the relatively small size of the orifice 55 so that the pressure in the passage 40 in the vicinity of the seat 41 is reduced. Appropriate seal rings prevent leakage past the outer surfaces of the flanges 53, 54 of the spool 47. Although one orifice 55 is shown in FIGS. 2–4, more than one could be used to provide a cumulative flow area that meets design criteria.

The upper end portion 57 of the port sleeve 46 is threaded at 58 to the lower end of a spring housing tube 60, and the upper end of the tube 60 is threaded at 61 to the lower end of an upper sub 62. The sub 62 has an internal bore 63 which is threaded throughout its upper portion. A sealed plug 65 is threaded into the upper end of the sub 62 to close the upper end of the internal bore 63. An adjustment mandrel 66 is positioned in the bore 63 and has external threads 67 which engage the internal threads on the sub 62 to provide an axial cam arrangement that is responsive to relative rotation. A slot 70 in the upper end of the mandrel 66 allows a tool such as a screwdriver to be used to thread the mandrel upward or downward in the sub 62 for purposes to be described below. The mandrel 66 has a depending skirt 71 which surrounds a blind bore 72 that is communicated to the outside of the sub 62 by radial ports 64 and 73. Of course the plug 65 can be temporarily removed to gain access to the adjustment mandrel 66.

The valve member 26 includes a lower stem 80 and an upper stem 81 that are threaded together at 82 as a rigid assembly. The lower stem 80 has a semi-spherical recess 83 on its lower end that mounts a spherical valve element or ball 84 that, when engaged with the upper inner edge of the seat ring 41, prevents fluid flow in the downward direction and into the tubing 13. The ball element 84 can be secured in the recess 83 by any suitable means such as soldering. The stem 80 slides through the orifice spool 48 with a fairly close manufacturing tolerance as the valve member 26 moves between a lower closed position and an upper open position. The upper stem 81 of the valve member 26 has a length of external threads 85 that receive an adjusting nut 86 and a locking nut 87. A coiled compression spring 88 reacts between the adjusting nut 86 and an upwardly facing shoulder 90 on the adapter sleeve 37 and thus biases the valve member 26 in the upward or opening direction. The upper end surface 91 of the stem 81 is conically shaped and engages the lower inner edge 92 of the skirt 71 to stop upward movement of the valve element 26 in its open position, so that the axial position of the mandrel 66 determines the distance the valve element moves between closed and open positions. Such distance can be adjusted by threading the mandrel 66 upward or downward in the sub 62 with the valve element 26 stopped against the skirt 71. The initial preload force of the spring 88 in the opening direction is set by the position of the nuts 86 and 87 along the threads 85 on the upper stem 81. The transverse cross-sectional area at 92 is subject to differential pressure when the valve element 26 is open as shown in FIG. 2, whereas the transverse cross-sectional area inside the seat ring 41 is subject to a differential pressure when the valve element 26 is closed as shown in FIG. 3. In the open position the spring 88 exerts a preload force on the valve element 26 in the opening direction, and in the closed position this force is increased due to valve element travel and additional compression of the spring. The size of the area at 92 is somewhat smaller than the area of the seat ring bore 44.

The differential pressure valve 19 can readily be converted to a wireline retrievable device that can be run and set in a side pocket mandrel. The valve 19 would be run with a standard packing sub screwed onto the lower sub 27, and another typical packing sub and a running head would be connected to the upper sub 62. The valve assembly would then be run on a typical kickover tool and set in the side pocket of a mandrel which has fluid flow slots or ports to the outside between polish bores in which the packings seat. Thus the exterior of the valve would be subject to fluid pressure in the casing annulus while the closure ball 84 would be subject to pressure inside the tubing in the closed position.

In use and operation, the differential pressure or regulating valve 19 is assembled as shown in FIGS. 1, 2A, 2B and 4 of the drawings and the threads 28 on the lower end of the valve body 25 are connected to a lug 30 on the outside of the production tubing 13 so that the outside of the valve 19 experiences fluid pressure in the casing-to-tubing annulus 17. When the valve element 26 is in its lower or closed position, tubing pressure is present in the lower sub 27 and acts upward on the ball element 84 over a transverse area defined by the bore diameter of the seat 41, while external fluid pressure acts downward on the same area. The coil spring 88 exerts upward force on the valve member 26 that is the sum of its preload force and the force due to additional compression as the valve shifted closed. Thus, the valve element 26 will shift upward to the open position when the opening force due to the spring predominates over the closing force due to pressure differential in favor of the casing annulus.

When the valve 19 is open as shown in FIG. 2A, fluid under pressure enters the large ports 47 in the adapter 46 and passes through the restricted orifice 55. From there the fluid flows past the ball element 84, through the seat ring 41, past the check valve 34, and through the lug 30 into the bore of the tubing 13. The orifice 55 causes a drop in fluid pressure so that a lesser pressure, which may be considered to be tubing pressure, acts upward on the valve element 26 over the transverse area bounded by the line of contact 92 between the stem surface 91 and the lower end of the skirt 71. Annulus fluid pressure acts through the ports 73, 64 and downward and over the same area at 92. Initially the spring 88 applies upward force on the valve element 26 equal to its rate times the amount of initial compression thereof. When the force due to differential pressure across the area at 92 predominates over the spring force, the valve element 26 will shift downward and disengage from the skirt 71, which causes a larger transverse cross-sectional area defined by the diameter of the stem 80 to be subject to the differential pressure. Then the valve element 26 shifts rapidly downward while compressing the spring 88 until the ball element 84 engages the seat ring 41 to shut off fluid flow. Such rapid movement prevents throttling. Thus the closing differential pressure value is a function of the initial compression or preload of the spring 88 as set by the position of the nut 86 along the stem 81 and the area of the stem 81 at 92. Once the valve 19 is closed, the tubing pressure acts upward on the valve element 26 over the bore area of the seat 41 and the reopening differential pressure is a function of precompression of spring 88. The amount of initial spring compression and thus the opening force attributable to it can be adjusted as described above, and the length of valve element travel can be adjusted by moving the mandrel 66 and its skirt 71 toward or away from the seat ring 41. This adjustment in turn sets the amount of additional spring force that will be applied in the opening direction once the valve element 26 is moved to its closed position as shown in FIG. 3. Moreover, the valve element travel can be shortened, for example, by threading the mandrel 66 downward, and the corresponding increase in preload of the spring 88 relieved by threading the nuts 86, 87 upward. Of course the opposite adjustments also can be made, or any combination thereof.

Of course the objective of gas-lift well production is to maintain the pressure in the tubing 13 at the level of the fluid injection valve 19 at a low enough value that the natural formation pressure of the oil is sufficient to cause the oil to flow to the surface and into a gathering facility or production line at an acceptable rate. Thus the valve 19 operates basically by sensing the tubing pressure adjacent the lug 30 and opening to admit lift gas when that pressure becomes too high, which is indicative of increased density of the oil column. At a certain pressure differential the spring 88 is able to pull the valve element 26 up to the open position so that fluid is injected into the tubing 13. As the tubing pressure reduces due to reduced density of the oil on account of entrained fluid bubbles, the net force due to difference in pressures between annulus fluid pressure acting downward on the valve element 26 and reduced pressure acting upward thereon overpowers the spring 88 and causes the ball element 84 to close and terminate fluid injection. The reduced pressure is due to restricted orifice 55 which has a flow area that is far less than the area of the fluid entry ports 47 of the seat ring bore 44. The valve 19 will repeatedly open and close, as necessary, to maintain the oil density in the tubing 13 at an appropriate level.

The reopening pressure differential can be set at different levels while maintaining the same differential closing pressure. Adjustment of the reopening pressure differential is accomplished by rotating the mandrel 66 to change the axial spacing between the skirt 71 and the seat ring 41. As the skirt 71 is moved closer to the seat ring 41 the total travel of the valve element 26 is reduced. The adjusting nut 86 is threaded upward along the stem 81 so that the output force of the spring 88 due to preload is the same. Under these conditions the pressure differential required for reopening becomes less because the total spring deflection is less. However the pressure differential to close the valve element 26 remains the same. This feature allows the valve 19 to be used in existing well installations with side pocket mandrels. The valve 19 can be set to accommodate the vertical spacing between such existing side pocket mandrels, and the reopening differential pressure set to prevent the valve from reopening too soon or too close to the closing pressure. These features, together with the large bore size of the seat ring 41, ensures that the ball element 84 moves far enough away from the seat ring that its effect on the passage of fluid is very minimal, or nonexistent. The check valve 34 is designed for high injection rates with minimum pressure drop. These features in combination allow a variety of upstream chokes to be used to control the rate of injection through the valve 19.

As noted above, several valves 19 are spaced along the tubing 13 above the injection valve 19. The valves 19 are used to unload the annulus 17 of salt water or other liquid standing therein as production is initiated. Fluid under pressure is supplied to the annulus 17 via the surface line 18 and forces the liquid into the tubing 13 through open valves 19 until the lower end of the fluid column reaches the lowermost injection valve 19. The fluid pressure closes the uncovered valves 19 and maintains them closed as injection occurs through the lowermost valve 19. Since the pressure of the column of oil in the tubing 13 becomes progressively less at shallower depths. Thus the differential pressure holding the valves 19 closed increases so that they all remain closed. Fluid injection occurs only through the lower differential pressure regulating valve 19.

Referring now to FIG. 3, there is shown a normally closed differential pressure responsive well fluid transfer means, which may take any suitable form for communicating the well casing with the production tubing. In one suitable form of the invention the fluid transfer means can comprise a valve as shown generally at 95, which may be the bottom valve of the production tubing string shown in FIG. 1. If it is desired that the lowermost valve of the tubing string be a fluid regulating valve such as that shown at 19, then the differential pressure responsive valve 95 may be located at any suitable well depth above the lowermost fluid regulating valve. As shown in FIG. 3, the well fluid transfer valve is positioned for insertion within the valve pocket of a side pocket mandrel connected within a production tubing string.

The differential pressure responsive well fluid transfer valve 95 can serve a number of differing functions when provided in a tubing string. The valve 95 is initially normally closed and thus normally blocks communication of fluid from the well annulus into the tubing string until such time that it is subsequently opened by differential pressure significantly exceeding the differential pressure at which the differential pressure responsive regulating valves of the tubing string will function. In the alternative, the fluid transfer means may be controllably opened or closed in any suitable manner. The valve 95 can serve as an unloading valve to kick-off fluid production from the well by rapidly unloading standing fluid from the well casing and the tubing string. To accomplish this feature, annulus pressure is elevated carefully to a pressure level above that achieving a pressure differential at which the differential pressure valves operate so that all of the differential pressure valves will be closed. At a predetermined, elevated casing pressure, the valve opening pressure differential of the valve 20 is reached thus causing it to open and to introduce well fluid from the casing into the tubing string across an internal choke so that the tubing string and well casing are quickly unloaded of accumulated fluid and thereafter, after reduction of casing pressure, the well can be produced in normal fashion, by any suitable production process.

The fluid transfer valve 95 can also function as a "dump-kill" valve in the event bottomhole pressure of the well should suddenly increase by kicking of the well (sudden fluid pressure increase from the formation to be produced) so that the pressure increase is overcome by injected pressure to minimize the potential for well blowout. Even further, the valve 95 shown in FIG. 3, after pressure induced opening thereof, will function to continuously admit well fluid from the casing annulus into the production tubing across an internal choke restriction of the valve and, in the case of pressure fluctuation, will prevent back-flow of pressure through the valve by virtue of a uni-directional check valve contained therein.

The fluid transfer valve mechanism 95 of FIG. 3 incorporates an upper mounting body sub 94 defining an internal passage 96 and having an upper, externally threaded end 98 of reduced diameter as compared to the diameter of the body sub 94 and being adapted for threaded connection with a valve running tool. It should also be borne in mind that the well fluid transfer valve 95 is preferably retrievable and thus subject to wireline running and retrieving simply by providing it with appropriate latch means and external seals as shown in FIG. 3, for installation within a valve pocket of a side pocket mandrel of a tubing string and adapting it for installation and retrievable by wireline equipment. Also, if desired, the well fluid transfer valve may be installed downwardly or upwardly within a valve pocket of a side pocket mandrel without departing from the spirit and scope of the present invention. For side pocket mandrel installation, the well fluid transfer valve 95 may be provided with external seal assemblies as shown at 100 and 102 for the purpose of establishing sealing engagement between the valve and the internal polished sealing surface of the valve pocket or receptacle of a side pocket mandrel. The lower end of the seal assembly 100 is shown to be in supported engagement with an upwardly facing circular shoulder 101 while the upper end of the seal assembly is supported by the adjacent circular shoulder of a conventional latch assembly (not shown) that is connected to the valve by the external thread connection 98.

At the lower end of the body sub 94, the body sub defines an internally threaded section 104 for receiving the externally threaded upper section 106 of a port sleeve 108 having a plurality of fluid conducting ports 110 therein to permit fluid interchange with an internal annular chamber 112 that is defined within the port sleeve. The lower end of the body sub 94 also defines a cylindrical section 114 which is engaged by seals 116 carried by the upper portion of the port sleeve for the purpose of establishing a seal between the port sleeve and the body sub 94.

At its lower end the port sleeve 108 defines an internally threaded section 118 which receives the externally threaded upper section 120 of a seal sub 122 having an external circular shoulder 124 against which is seated the upper end of the packing assembly 102. As mentioned above, the packing assembly 102 is adapted for sealing engagement within a cylindrical internal polished bore of a tool or instrument pocket of a side pocket type mandrel for differential pressure valves and the like. The assembly 100 or 102 is provided with a central seal ring 126 with a plurality of Chevron seals 128 positioned on either side of the central seal ring. The seal assembly 102 is secured in place by a upwardly facing circular retainer shoulder 130 of a seal retainer sub 132. For its connection with the sub 122 the sub 132 is provided with an internally threaded upper section 134 which is received by the externally threaded lower section 136 of the port sub 122.

At its lower end the seal retainer sub 132 defines a tapered seal shoulder 138 against which is seated a circular sealing element 140 which may be composed of a suitable elastomer or polymer sealing material as desired, or may be composed of any composite materials including composites of polymers, elastomers or metals. The circular seal 140 may have a generally triangular cross-sectional configuration as shown or, in the alternative, it may be in any other suitable configuration for efficient sealing. The seal 140 is captured in part by a nose section 142 of the valve mechanism having an upper internally threaded section 144 which is received by an externally threaded lower section 146 of the sub 132. The nose section 142 defines at least one and preferably a plurality of flow passages 148 through which well fluid is able to flow in a directional manner as shown by the flow arrow 150. For controlling the flow of fluid through the valve mechanism a valve element 152 is provided having an elongate guide section 154 which is linearly moveable within an axial passage 155 of the nose section. The valve element 152 defines a circular valve head 156 having a tapered circular sealing surface for mating sealing engagement with the circular sealing element 140. The valve element is shown in its open position to permit the flow of well fluid into the tubing string from the casing annulus. In the event flow in the direction of the flow area should cease and a reverse flow condition occur, the valve element 152, being a check valve, will be closed so that backflow of fluid from the tubing into the well casing will be prevented. Internally of the sub 132 is defined a circular downwardly facing shoulder 158 against which is seated a circular choke element 160 which defines a choke orifice 162. Flow through the valve mechanism in the direction of the flow arrow must occur through the restricted flow orifice. Thus, the flow orifice 162 may be of a suitable dimension for continuous injection of well fluid through the valve mechanism and into the production tubing string of the well for production.

At its upper end the tubular port sub 122 defines a cylindrical, polished internal sealing surface 164 which is engaged by a circular sealing element 166 that is carried by the reduced dimensioned, cylindrical lower end section 168 of an elongate piston 170. The upper end 172 of the valve piston 170 is provided with a circular sealing element 174 which is disposed for sealing engagement with a cylindrical, polished interior surface 176 of the body sub 94. The diameter of the sealing interface of the sealing element 174 and the internal cylindrical sealing surface 176 of the body sub 94 is greater than the sealing interface diameter of the circular sealing element 166 with the cylindrical internal sealing surface 164 of the port sub 122. Thus, fluid pressure present in the annular chamber 112 via the fluid conducting ports 110, by virtue of the differences in seal interface diameter at the upper and lower ends of the elongate valve piston 170 develops a resultant force acting upwardly on the valve piston 170 as shown in FIG. 3. The pressure induced resultant force acting on the valve piston 170 is in the direction to move it upwardly within a piston chamber 173 that is defined in part by the body sub 94. Upward movement of the elongate valve piston 170 responsive to pressure induced resultant force is prevented by one or more shear element 180 which extend through an upper wall structure of the body sub 94 so that the inner extremity 182 thereof is received within a corresponding receptacle 184 defined within the upper end of the valve piston 170. The receptacle 184 may simply be a drilled blind bore or preferably it will take the form of a circular groove within the lower end of the valve piston to simplify the assembly procedure.

Under the normal force range of fluid pressure of production operations the resultant force acting on the elongate valve piston 170 will be insufficient to shear the shear screw projection 184. Thus, the valve mechanism generally shown at 20 will be closed under normal well operating pressure conditions and will be opened only at elevated casing pressure so that inadvertent opening of the fluid transfer valve will not occur until backside testing procedure has been complete.

When it is desired that the valve piston 170 be shifted under the influence of resultant force of its closed position shown in FIG. 3 to the open position the annulus pressure of the well is increased well above the differential pressure valve operating pressure range to a level that is sufficiently great that the resultant force acting on the valve piston 170 will be sufficient to cause shearing of the projection 182 of the shear screw or screws 180. When the frangible portion of the shear screw is fractured, the elongate piston is released for opening movement. So that it moves upwardly as shown in FIG. 3. As soon as the circular seal 166 clears the upper end of the sealing surface 164 fluid pressure within the internal chamber 112 will be acting across the entire circular cross section of the valve piston as defined by the circular sealing element 174. This pressure induced force will move the valve piston 170 downwardly to its full extent within the piston chamber 176 so that well fluid from the annulus and within the internal chamber 112 will then be free to flow through the metering orifice 162 of the choke 160 and into the flow passage 148 downstream of the choke. The well fluid will then flow through the unidirectional valve mechanism that is defined by the valve element 152 and the valve seat 140 after shearing of the shear screws 180 the valve piston 170 will remain open so that fluid from the casing annulus is permitted to continuously flow across the choke orifice 162 and into the tubing string. Thus, after valve piston opening, fluid from the well continues to flow from the internal chamber 112 through the choke 162 and across the check valve mechanism and into the tubing string for producing the well.

Assuming that it should become desirable to string at a pressure exceeding backside test pressure as discussed above, it may also be desirable to terminate such casing fluid flow through the fluid transfer valve or to change the rate of well fluid flow into the tubing the valve 20 may be equipped for selective positioning for closure or for flow changing positioning valves in usual manner.

Figure 5:
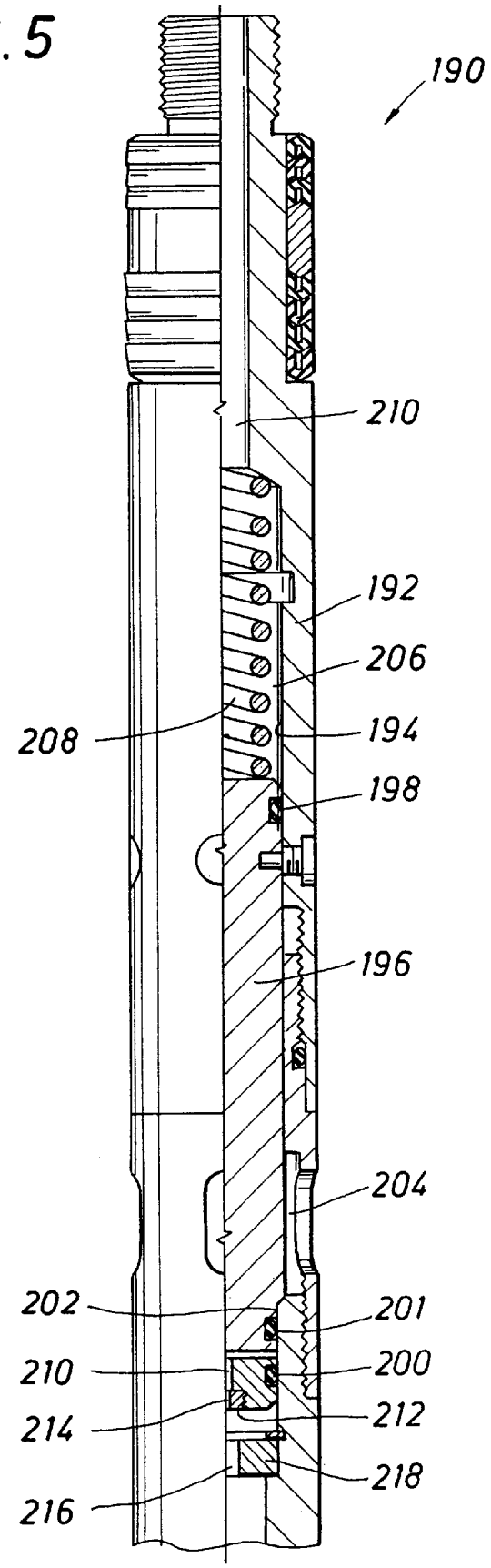

To accomplish this feature, a fluid transfer valve for unloading the well, transferring well fluid from the casing into the tubing and for accomplishing other features is shown generally at 190 in FIG. 5 and may be of same general construction as the valve mechanism shown in FIG. 3, with the difference being the capability of the valve to close or to be shifted to a desired position responsive to differential pressure after having been released for opening by elevated differential pressure. The valve mechanism of FIG. 5 incorporates a valve body 192 having an internal cylindrical passage 194 within which a valve piston 196 is linearly moveable. The piston 196 is sealed with respect to the internal cylindrical surface 194 defining the passage by a circular sealing element 198 that is carried within a circular seal groove of the valve piston. The valve piston 196 is opened by elevated differential pressure acting on the circular piston surface area being defined by the difference in diameter of the lower piston seal 201 with an upper piston seal 198 to permit initial backside pressure testing with the differential pressure valves in place within the production tubing. As soon as the lower piston seal 198 clears the internal cylindrical sealing surface 202 against which it is seated well fluid pressure within the internal chamber 204 will act on the entire lower surface area of the valve piston, thus driving it upwardly from the position shown in FIG. 5. Above the valve piston 196, the cylindrical internal surface 194 defines a piston return chamber 206 having means therein for applying a downward force to the valve piston to thereby move the valve piston to its closed position in absence of piston opening force. One suitable means for returning the valve piston to its closed or other selected position may conveniently take the form of a compression spring 208 which continuously exerts an upward spring force on the valve piston. As soon as the well fluid pressure acting upon the piston to hold it open is diminished to the point that the spring force overcomes the pressure induced valve opening force, the spring force of the spring 208 will return the valve piston 196 to its closed or selected position, thus ceasing transfer of well fluid from the casing annulus into the tubing string through the valve mechanism 190. For controlling diminished flow of well fluid through the valve 190, the valve piston may have a reduced flow passage 210 having its entrance opening located between seals 200 and 201. The flow passage 210 may also be provided with a choke 212 having a flow passage 214 of smaller dimension as compared to the orifice 216 of the choke element 218. Thus, depending on the position of the valve piston, as determined by differential pressure, well fluid flow through the valve may be controlled by the small orifice 214 or the large orifice 216.

It should borne in mind that instead of the spring force of the compression spring 208, the means for returning the valve piston to its closed or changed flow position may take various other suitable forms. For example, a return fluid pressure from a pressurized accumulator in controlled communication with the internal chamber 206 may be utilized to develop a positioning force on the valve piston assuming that the internal passage 210 of the valve housing 192 is closed or selectively positioned by a valve or by other suitable means.

During installation of a production system for a well, the fluid level within the well casing will typically be at a standing level well above production level. Thus, within the tubing string a similar standing level of well fluid will also typically exist. For the production system to become initiated, it will be necessary for the well to be unloaded of standing level fluid down to a desired level in relation to the level of the fluid transfer means of the tubing string. As mentioned above, when typical production systems are installed usually only one or more of the upper differential pressure valves will function while the valves at the lower end of the production tubing string will remain closed due to the pressure differential that is caused by the standing fluid level of the well. The differential pressure valves will open as the proper pressure differential is reached between casing pressure and tubing pressure so that the first valve to open will be the uppermost differential pressure valve after the tubing string has been unloaded to a particular level, the next differential pressure valve in sequential well depth will become open as its operating pressure differential is reaching, thereby unloading an additional section of the tubing string. This activity continues sequentially until such time as the well fluid, oil, entrained natural gas, etc., water, is unloaded to the production level of the well. Thereafter, virtually all of the upper differential pressure valves will remain closed and the well can then be produced by any suitable production system.

At times the standing fluid level in a well will make it very difficult for the production system of the well to unload it to the productive level of the well. To compensate for this shortcoming it is desirable to provide a valve mechanism that can be opened selectively to significantly enhance unloading of the well and to thus prepare the production system for production of the well. Thus, a need exists for a means by which elevated fluid pressure may be introduced into the tubing string of a well via a fluid transfer valve, typically located at the lower or bottom of the tubing string for the purpose of rapidly unloading standing fluid within the production tubing so that, thereafter, proper production of the well can be accomplished. The selectively operable fluid transfer valve mechanism shown in FIG. 3, when utilized in conjunction with one or more differential pressure valves in a production tubing string, efficiently accomplishes the various features indicated above.

From the standpoint of pressure testing, as indicated above, it is desirable, after landing a tubing string within the well casing of the well, to insure the sealing integrity of all of the seals, packers and other sealing components of the well production installation prior to placing the well in production.

OPERATION

The method of installation and use of the well completion and backside pressure testing system of the present invention will typically be as follows:

A tubing string having one or more differential pressure responsive valves will then be run into a well casing and properly landed and sealed with respect to the well casing by means of packers. The tubing string will also incorporate well fluid transfer means of the nature set forth in FIG. 3 hereof and will incorporate one or more differential pressure responsive valves, which may take the form of gas-lift valves. Prior to placing the well in production operation it is desirable to test the integrity of the various sealing components thereof.

Preferably, to protect the production formation during backside pressure testing, the casing will not be perforated until backside pressure testing has been completed. In such case, prior to running the production tubing, a casing perforating gun will be positioned within the casing at the depth of the formation of interest. The tubing string is run with its spaced mandrels and differential pressure responsive valves in place within the mandrel pockets and ready for producing the well through utilization of any suitable system for production. At this point in the well completion procedure, the standing level of the well fluid in the casing will be at its maximum. At times, to minimize the potential for well blow-out, the standing liquid within the well casing may be drilling fluid having heavy, abrasive particulate that should be flushed from the well casing before production of the well is initiated. Preferably, the standing fluid within the well casing will be clean fluid that will ensure against contaminant interference with any of the differential pressure responsive valve mechanisms of the production system.

With the production tubing string landed and sealed, liquid pumps will be typically used to raise casing pressure to backside test pressure. This is done carefully to prevent the development of pressure spikes that may exceed the pressure that is needed for developing sufficient pressure induced force on the valve piston of the fluid transfer valve 20 for shearing the shear screws and releasing the valve piston for differential pressure induced opening. Casing pressure is also increased carefully to ensure closure of all of the regulating valves of the tubing string. With these valves closed and the transfer valve retained closed by the shear screws, casing pressure is elevated by the pumps until backside test pressure is reached. After holding backside test pressure for a sufficient period of time to confirm the integrity of the seals and packers, the casing pressure is then further elevated by the pumps to develop sufficient differential pressure induced force on the valve piston to shear the shear screws and thus release the valve piston for differential pressure responsive opening. The regulating valves of the tubing string will all remain closed because of the elevated pressure and because of the standing fluid of the well casing.

In cases where casing perforation is deferred until backside pressure testing has been completed, the casing pressure is preferably substantially balanced with formation pressure and the casing is then perforated by firing of the perforating gun so that formation pressure will be in communication with the well casing. The balanced or slightly unbalanced pressure of the casing with respect to the pressure of the production formation will minimize the potential for fouling of the formation with fluid from the casing. Also, if desired, the fluid pressure of the well casing can be significantly below the pressure of the production formation, so that, upon casing perforation, the formation fluid will immediately flush the casing clean of contaminants. This flushing activity will occur through the fluid transfer means so as to protect other flow controlling components of the tubing string from potential damage. The standing fluid within the casing will then be carried immediately through the tubing string to the surface. Additional fluid may then be pumped into the well casing at the surface for additional flushing of the well if deemed appropriate to the completion procedure. Also, fluid, typically a gas, may be introduced into the well casing at elevated pressure to forcibly unload the well casing through the open fluid transfer valve to a desired production level. This will be done if the standing fluid of the casing contains particulate that could erode or otherwise interfere with the differential pressure responsive valves of the tubing string.

After unloading of the well casing the fluid pressure in the casing annulus will be reduced to a desired operating pressure range so that the well can then be produced by formation pressure or by any other suitable production procedure.

In view of the foregoing, it is evident that the present invention is one well adapted to attain all of the objects and features that are hereinabove set forth, together with other objects and features which are inherent in the apparatus disclosed herein.

As will be readily apparent to those skilled in the art, the present invention may be produced in other specific forms without departing from its spirit, scope and essential characteristics. The present embodiment is therefore to be considered as illustrative and not restrictive, the scope of this invention being defined by the claims rather than by the foregoing description, and all changes which come within the meaning and range of equivalence of the claims are therefore intended to be embraced therein.

What is claimed is:

1. A method for completing and pressure testing a well having a well casing lining a well bore that intersects a subsurface production formation, comprising:

(a) running into the well casing a well production tubing string having connected therein at least one differential pressure responsive valve being open within a predetermined differential pressure range between the well casing and production tubing for establishing fluid communication between the well casing and said production tubing string and closing responsive to differential pressure above said predetermined differential pressure range for blocking fluid communication between the well casing and said production tubing string;

(b) establishing at least one seal between the well casing and said production tubing string;

(c) increasing fluid pressure within the well casing to a back-side test pressure being above said predetermined differential pressure range;

(d) maintaining said back-side test pressure for a sufficient period of time to confirm the integrity of said at least one seal between the well casing and said production tubing string;

(e) unloading fluid from the well casing to a desired production level; and (f) producing fluid entering the well casing from the subsurface production formation.

2. The method of claim 1, wherein said production tubing string also having therein fluid transfer means for selective communication of the well casing with said production tubing string, said method comprising:

(a) communicating said production tubing string with the well casing through said fluid transfer means for unloading standing fluid from the well casing;

(b) unloading fluid from the well casing through said production tubing string; and (c) initiating production of fluid entering the well casing from the subsurface formation through said production tubing string.

3. The method of claim 2, wherein:

said unloading fluid from the well casing occurring through said fluid transfer means.

4. The method of claim 2, wherein said fluid transfer means is a fluid transfer valve and valve retainer means is located within said fluid transfer valve and maintains said fluid transfer valve in the closed position thereof until said valve opening pressure differential pressure is reached, whereupon said valve retainer means then permits differential pressure responsive opening movement thereof, said method comprising:

increasing fluid pressure within said casing sufficient for releasing actuation of said valve retainer means and permitting differential pressure responsive opening of said fluid transfer valve.

5. The method of claim 2, wherein valve retainer means normally maintains said fluid transfer means in the closed position thereof until said valve opening differential pressure is reached, whereupon said retainer means releases said fluid transfer means for opening movement thereof, the method comprising:

increasing fluid pressure within said casing to a predetermined pressure above backside test pressure for releasing of said retainer means causing differential pressure responsive opening of said fluid transfer means.

6. The method of claim 2, wherein frangible retainer means maintains said fluid transfer means closed, at a predetermined differential pressure between casing pressure and production tubing pressure said retainer means fracturing and releasing said fluid transfer means for differential pressure responsive opening movement thereof, said method comprising:

increasing casing pressure sufficiently to above backside test pressure to develop sufficient differential pressure induced force on said frangible retainer means to cause fracture thereof, thus releasing said valve fluid transfer means for differential pressure responsive opening thereof.

7. The method of claim 1, wherein the subsurface production formation has a formation pressure and the well casing has an casing pressure at the depth of the subsurface production formation that is determined by the standing level of fluid within the well casing and the fluid pressure within the well casing, said method comprising:

(a) after confirming the integrity of said at least one seal, substantially balancing casing pressure at the depth of the subsurface production formation with formation pressure; and (b) perforating the well casing at the depth of the subsurface production formation.

8. The method of claim 1, comprising:

(a) locating within said production tubing string a fluid transfer valve having an open position permitting the flow of fluid from the well casing into said production tubing string and a closed position blocking the flow of fluid from the well casing into said production tubing string, said fluid transfer valve being initially at said closed position and being moved to said open position responsive to predetermined differential pressure between well casing pressure and production tubing pressure;

(b) upon said differential pressure responsive opening of said fluid transfer valve, injecting fluid into said well casing at a pressure and flow rate for unloading standing fluid from said well casing through said fluid transfer valve and into said production tubing string; and (c) after said initially unloading standing well fluid from said well casing tubing string, reducing fluid pressure within said well casing to a predetermined pressure range and flow rate for production of well fluid entering the well casing from the subsurface earth formation and flowing into said production tubing through said fluid transfer valve.

9. The method of claim 1, wherein a choke element is located within said fluid transfer valve and defines a flow restriction through which well fluid must flow, the method comprising:

(a) locating within said production tubing string a fluid transfer valve having an open position permitting the flow of fluid from the well casing into said production tubing string and a closed position blocking the flow of fluid from the well casing into said production tubing string, said fluid transfer valve being initially at said closed position and being moved to said open position responsive to predetermined differential pressure between well casing pressure and production tubing pressure;

(b) maintaining said fluid transfer valve in the open position after differential pressure responsive opening thereof; and (c) establishing a pressure range and fluid supply rate within said well casing for operation of said plurality of differential pressure responsive valves and for continuous flow of well fluid from said casing into said production tubing string through said flow restriction of said choke.

10. The method of claim 1, wherein the subsurface production formation has a formation pressure and the well casing has an casing pressure at the depth of the subsurface production formation that is determined by the standing level of fluid within the well casing and the fluid pressure within the well casing, said method comprising:

(a) after confirming the integrity of said at least one seal, establishing a desired casing pressure in relation with formation pressure; and (b) perforating the well casing at the depth of the subsurface production formation.

11. A method for downhole pressure testing of wells being completed for production of well fluid therefrom, comprising:

(a) installing within a well casing a production tubing string having therein a plurality of differential pressure controlled valves located therein for communicating the well casing with said production tubing string, the differential pressure controlled valves being open within a predetermined differential pressure range to permit the flow of fluid from the well casing into said production tubing string and closing responsive to a predetermined maximum differential pressure to block the flow of fluid from the well casing into said production tubing string, said production tubing string also having therein fluid transfer means having an open condition permitting flow of fluid from the well casing into said production tubing string and a closed position blocking the flow of fluid from the well casing into said production tubing string;

(b) establishing sealing means between the well casing and said production tubing string;

(c) increasing fluid pressure within said casing sufficiently to exceed said predetermined maximum differential pressure, thereby causing differential pressure induced closing of all of said differential pressure controlled valves;

(d) further increasing fluid pressure in said well casing to a desired backside test pressure;

(e) maintaining said backside test pressure for a sufficient period of time to confirm the integrity of said sealing means;

(f) opening said fluid transfer means;

(g) unloading fluid from the well casing through said fluid transfer means; and (h) initiating production of fluid entering the well casing from the subsurface production formation.

12. The method of claim 11, wherein said fluid transfer means is differential pressure responsive and opens at a predetermined fluid transfer pressure differential between the well casing and said production tubing string, said method comprising:

(a) after confirming the integrity of said seal means, further increasing fluid pressure within said well casing until a predetermined fluid transfer pressure differential is reached thus opening said fluid transfer means, said fluid transfer pressure differential being established by a casing pressure above said backside test pressure; and (b) unloading fluid from the well casing into said production tubing string through said fluid transfer means.

13. In a well production system having a wellbore intersecting a subsurface production formation and having a well casing lining the wellbore, the improvement comprising:

(a) a production tubing string being landed within the well casing and having therein at least one differential pressure responsive valve for controlling fluid flow from the well casing into the production tubing string at a valve operating range of differential pressure between the well casing and production tubing string having a low pressure differential for opening the differential pressure responsive valve and a high pressure differential for closing the differential pressure responsive valve;

(b) seal means establishing at least one seal between the well casing and said production tubing string; and (c) fluid transfer means being provided in said production tubing string and having a closed condition blocking the flow of fluid from the well casing into said production tubing string and an open condition permitting flow of fluid from the well casing into said production tubing string, said fluid transfer means capable of remaining at said closed condition when casing pressure is elevated above said valve operating differential pressure range for differential pressure responsive closure of said differential pressure responsive valve and to permit application of a backside test pressure within the well casing to confirm the sealing integrity of said seal means.

14. The improvement of claim 13, wherein:

said fluid transfer means being moved to said open condition thereof responsive to a predetermined fluid transfer pressure differential exceeding said backside test pressure.

15. The improvement of claim 13, wherein:

(a) said production tubing string having a fluid transfer valve pocket in fluid communication with said well casing and with said well casing and with said production tubing string; and (b) said fluid transfer means being a flow controlling valve.

16. The improvement of claim 13, wherein:

(a) said fluid transfer means being a fluid transfer valve; and (b) means controlling movement of said fluid transfer valve from said closed condition to said open condition permitting unloading of fluid from the well casing through said fluid transfer valve and into said production tubing string.

17. The improvement of claim 16, wherein:

(a) said fluid transfer valve having a valve body defining an internal piston chamber (b) a differential pressure responsive piston valve being linearly movable with said piston chamber from a closed position blocking flow of pressurized fluid from the well casing into the production tubing string and an open position permitting fluid flow through said injection valve into the production tubing string; and (c) means restraining opening movement of said differential pressure responsive piston valve until a predetermined valve release casing pressure has been reached and releasing said piston valve for opening movement when said predetermined valve release casing pressure is reached.

18. The improvement of claim 17, wherein:

said means restraining said piston valve being frangible means which fracture when said predetermined valve release casing pressure is reached, thereby releasing said piston valve for differential pressure responsive opening movement thereof.

19. The improvement of claim 18, wherein:

a choke element being located within said valve body and defining a restricted flow passage through which well fluid must flow from said casing annulus into said production tubing string.

20. The improvement of claim 16, wherein:

means within said fluid transfer valve permitting flow of well fluid from the well casing into said production tubing string and preventing backflow of well fluid from said production tubing string into the well casing.

* * * * *